United States Patent [19]

Mongia et al.

[11] Patent Number: 5,020,587

[45] Date of Patent: Jun. 4, 1991

[54] FULLY FLOATING TUBE BUNDLE

[75] Inventors: Manmohan Mongia, Decatur, Ga.; Shelby J. Meade, Wilmington, N.C.

[73] Assignee: Lennox Industries Inc., Dallas, Tex.

[21] Appl. No.: 607,539

[22] Filed: Nov. 1, 1990

[51] Int. Cl.[5] ..... F28F 7/00

[52] U.S. Cl. ..... 165/82; 165/149; 165/150; 29/890.043

[58] Field of Search ..... 29/890.043, 890.044; 165/81, 82, 149, 151

[56] References Cited

U.S. PATENT DOCUMENTS

| | | | |
|---|---|---|---|
| 2,072,975 | 3/1937 | Winsborough et al. | 165/82 |
| 2,211,335 | 8/1940 | Lindemann | 165/82 X |
| 2,267,314 | 12/1941 | Stikeleather | 165/150 X |
| 2,816,738 | 12/1957 | McElgin | 165/150 X |
| 3,368,614 | 2/1968 | Anderson | 165/82 |
| 4,164,255 | 8/1979 | Binet et al. | 165/82 |

*Primary Examiner*—Allen J. Flanigan

*Attorney, Agent, or Firm*—Allegretti & Witcoff, Ltd.

[57] ABSTRACT

An air cooled heat exchanger is comprised of a plurality of generally parallel fluid carrying tubes joined at the ends so as to form a refrigerant circuit which is free floating with respect to its means of support. The fluid carrying tubes are directly connected to heat transfer fins running generally perpendicular to the tubes. The fins in turn are connected to non-fluid carrying support tubes which are generally parallel to the fluid carrying tubes. The support tubes are secured at their ends to end plates and as necessary to a center plate or plates. There is no direct contact between the end plates or center plates and the fluid carrying tubes, which are free to move with respect to the end plates and center plate or plates. Therefore, damage to the fluid carrying tubes and leakage which often occurs at the connection between a fluid carrying tube and a support plate due to abrasion caused by vibration and temperature changes is eliminated.

8 Claims, 1 Drawing Sheet

FULLY FLOATING TUBE BUNDLE

BACKGROUND OF THE INVENTION

This invention generally relates to air cooled heat exchangers. More specifically, this invention relates to an improved method and structure for supporting fluid carrying tubes of air cooled heat exchangers which may be used for condensers or evaporators in refrigeration stems. Heat exchangers of the type contemplated by the present invention commonly include tube bundles with a relatively large number of thin walled copper parallel tubes connected in pairs at their ends by return bends to form a fluid circuit. Fins are secured generally transverse to the parallel tubes to enhance heat transfer. It is common in the prior art to provide a rigid connection between the tubes of the tube bundle and the supporting means at each end of the tubes.

For purposes of simplifying explanation, the following description pertains to an application where the heat exchanger is a condenser. In use, air is passed over the tubes of the air cooled condenser in order to lower the temperature of, and hence condense, a vaporous refrigerant fluid flowing through the tubes from a refrigerant compressor. During this cooling process the tube bundle is subject to vibrations caused by pulsations of the fluid flowing within the condenser, as well as outside disturbances. Furthermore, the tubes forming the tube bundle are subject to expansion and contraction due to changes in temperature during the heat exchange process. As a result of the vibrations and the temperature changes there is great stress placed upon the tubes at locations where they are rigidly attached, for example, between the end plates at each end of the tubes of the tube bundle. This stress often results in leakage at these points of contact. One possible solution to the problem was to use thicker wall copper tube. However, this undesirably increased weight and expense. Another possible solution was to use softer tube support materials to absorb movement due to vibration and expansion and contraction. This solution too was undesirable.

Accordingly, there is a need for an improved mounting means between the fluid carrying tubes and the end plates of an air cooled heat exchanger to eliminate the rigid contact between the fluid carrying tubes and the end plates in order to obviate heat exchanger leakage problems and to do so in a relatively simple, cost effective manner.

THE PRIOR ART

The prior art shows heat exchangers in which fluid carrying tubes are rigidly held in place at their ends in end plates, thus causing the problem which is solved by the present invention.

Wepfer (1987) U.S. Pat. No. 4,665,866, relates to a grid-type flow distribution baffle for use within a steam generator. Wepfer directly mounts the fluid carrying tubes of the heat exchanger within the supporting tube sheet.

Waryasz (1986) U.S. Pat. No.4,619,315, relates to an in bed heat exchanger of a fluidized bed furnace having a support bracket for supporting its tubes. The fluid carrying tubes of the heat exchanger are directly supported by the support bracket comprising one or more plates engaging a wear channel carried on a support plate that is in turn affixed to a beam and a pillar.

Fournier (1986) U.S. Pat. No. 4,589,618, relates to a device for holding in position a set of tubes of a heat exchanger tube bundle to limit the possibility of vibration. The thrust of Fournier is to hold the fluid carrying tubes firm by using a clamping means to dampen the vibrations of the fluid carrying tubes at their ends. This clamping means forms the support of the tube bundle as it is affixed both to the fluid carrying tubes and to the side of the heat exchanger vessel.

Kerr (1986) U.S. Pat. No. 4,578,850, relates to a method of manufacturing a heat exchanger whereby the fluid carrying tubes of the tube bundle are sealingly disposed to the supporting walls. Kerr is concerned with maintaining a permanent seal between the heat exchanger tubes and the support plates.

Kissinger (1979) U.S. Pat. No. 4,154,295, relates to a heat exchanger having a support for the heat exchanger tubes which permits relatively unobstructed passage of heat exchanger fluids about the tubes in the bundle. The supporting means limit the movement of the tubes in the tube bundle, Anthony (1969) U.S. Pat. No. 3,423,287, relates to a nuclear reactor fuel element support. The fuel elements supported by Anthony are affixed to the header plates at either end.

Raub (1960) U.S. Pat. No. 2,956,787, relates to means of supporting heat exchanger baffles through the use of tie rods which run parallel to the heat exchanger tube bundle. The fluid carrying tubes of the heat exchanger, however, are cemented or otherwise fixedly attached to sockets in the end plates.

Boni (1960) U.S. Pat. No. 2,936,159 relates to the design of a compartmentalized heat exchanger in which the fluid carrying tubes of the tube bundle are affixed at their ends to tube sheets.

Meixl (1950) U.S. Pat. No. 2,496,301 also relates to the design of a heat exchanger in which the fluid carrying tubes of the tube bundle are affixed at their ends to tube sheets.

None of the prior art known to applicant suggests the unique air cooled heat exchanger of the present invention.

SUMMARY OF THE INVENTION

In accordance with the present invention, a support system for the tube bundle of an air cooled heat exchanger which allows free floating of the tube bundle is disclosed. It is an object of this invention to provide an air cooled heat exchanger wherein there is no fixed contact between the fluid carrying tubes and the support walls so that fatigue and leakage of the tubes at the support walls are eliminated.

Another object of the present invention is to provide an improved air cooled heat exchanger utilizing non-fluid carrying tubes secured to end plates, with the fluid carrying tubes connected to the non-fluid carrying tubes by fins, thereby avoiding fixed contact between the fluid carrying tubes and the end plates. Other objects and advantages of the present invention will be more apparent hereinafter.

The air cooled heat exchanger is comprised of a plurality of generally parallel fluid carrying tubes, pairs of which are connected at their ends to form a refrigerant circuit. A plurality of non-fluid carrying tubes or support tubes which run generally parallel to the fluid carrying tubes are connected to the fluid carrying tubes through the use of fins. The fins run generally perpendicular to the non-fluid carrying tubes and the fluid carrying tubes. Both the non-fluid carrying tubes and the fluid carrying tubes are securely connected to the fins to form a tube bundle. Supporting plates are placed at each end of the tube bundle, and more may be placed at intervals along the length of the tube bundle, if needed, depending upon the length of the fluid carrying tubes. The supporting plates extend generally perpendicular to the support tubes and the fluid carrying tubes and generally parallel to the fins. The support tubes are secured to the supporting plates while the fluid carrying tubes of the tube bundles pass through openings in the supporting plates. The diameters of the openings in the supporting plates are substantially greater then the outside diameter of the tubes. This allows for free floating of the fluid carrying tubes comprising the tube bundle with respect to the support plates. By eliminating fixed contact between the fluid carrying tubes of the tube bundle and the support plates, damage and leakage of the fluid carrying tubes due to vibration and temperature change may be obviated.

BRIEF DESCRIPTION OF THE DRAWINGS

There is shown in the drawing a presently preferred embodiment of the present invention, wherein like numerals refer to like elements in the various views, and wherein.

DESCRIPTION OF THE PREFERRED EMBODIMENT

Figure 1:
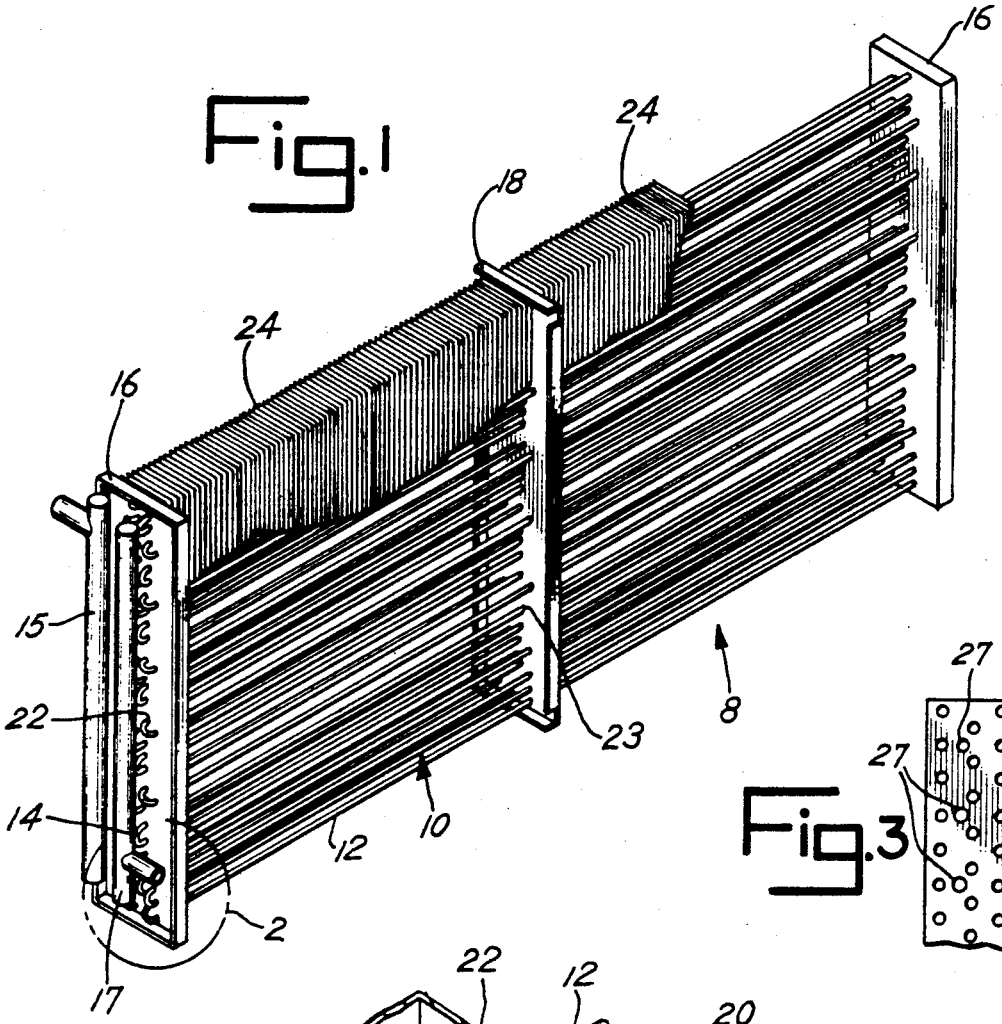
FIG. 1 is a perspective view of an air cooled heat exchanger including the tube bundle and the support mechanism of the present invention.

The present invention relates to an air cooled heat exchanger 8 (condenser or evaporator) including a tube bundle of the type generally indicated at 10. The tube bundle is comprised of a multiplicity of substantially parallel tubes 12 which are constructed and arranged in a spaced apart relation and connected at their ends to form a refrigerant circuit to allow circulation of a fluid through the tubes. Air is passed over the outside of the tubes to allow for proper heat exchange between the fluid carried in the tubes and the air. The tubes 12 of the tube bundle 10 are connected in pairs at their ends by return bends 14 to provide a circuit for refrigerant. The tubes 12 are suitably connected to inlet and outlet headers 15 and 17 which are in turn connected in a refrigerant system. Preferably the fluid carrying tubes 12 are made from thin walled copper or a similar metal having desirable strength and heat transfer properties. The tube bundle 10 is adapted to be connected to a refrigerant compressor (not shown) via the inlet header 15. High pressure vaporous refrigerant from the compressor is passed to the air cooled condensor 8, where the vaporous refrigerant is condensed. Then the refrigerant passes from the condenser 8 through outlet header 17 through an expansion device to an evaporator, where it is expanded. The air passing over the evaporator is cooled. Refrigerant is returned from the evaporator to the compressor through the suction line. The basic operation of a refrigerant system is known and forms no part of this invention.

The supporting mechanism for the tube bundle 10 is comprised of two end plates 16, one or more center plates 18, and non-fluid carrying support tubes 20. Various openings 22 are contained within the end plates 16. Similar openings 23, are contained in the center plate 18. These openings 22 and 23 are of a diameter larger than that of the tubes 20 as well as the tubes 12 of the tube bundle 10, as will be explained more fully hereafter. The tubes 20 are fixedly secured to the end plates 16, as for example by a force fit interconnection and then welding or soldering same into suitable openings in the end plates 16. Preferably, each support tubes 20 is expanded, after positioning it within an associated opening, to the diameter of the opening so as to be rigidly affixed therein. Support tubes 20 normally do not carry fluid and are not part of the refrigerant circuit. They may be hollow and carry auxiliary fluid. They may be solid or tubular and may be circular or have another cross sectional configuration. For strength, the tubes 20 are preferably made from metal such as copper. The end plates 16 and center plate or plates 18 are preferably made from metal such as galvanized steel. The fluid carrying tubes 12 have an outside diameter substantially smaller then the diameter of the openings 22 of the end plates 16 such that the tubes may pass through the openings 22 without any contact, thus allowing for freedom of movement. The diameter of the openings 22 may vary, and the diameter of the openings 22 accepting the tubes 12 and these openings accepting the tubes 20 do not have to be the same. In one presently preferred embodiment of the invention, the fluid carrying tubes 12 are made from inch copper tube having $\frac{3}{8}$ inch outside diameter and the support tubes 12 are made from copper tube having $\frac{1}{2}$ inch outside diameter. The $\frac{1}{2}$ inch outside diameter support tubes 20 are expanded into 0.515 inch holes in the fins 24 and the end plates 16 and secured thereto. The openings 22 in the end plates 16 (and the openings 23 in the center plate 18) are 0.625 inch inside diameter for loosely receiving the tubes 12 to permit free movement of the tubes 12 and floating of the tube bundle 10 with respect to the support means comprising end plates 16 and center plate 18. The tubes 12 and 20 are generally thin walled, on the order of 0.016 inch in a preferred embodiment. In such embodiment which is illustrative of the invention, there are sixteen (16) support tubes 20 for carrying the tube bundle 10 comprised of one-hundred twenty-eight (128) tubes 12 approximately seven feet long. A single center plate has been found satisfactory.

Figure 3:
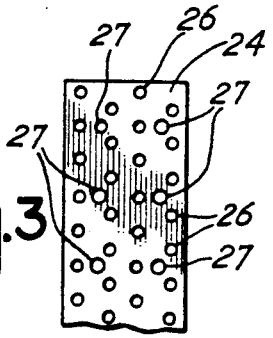
FIG. 3 is an elevation view of a fin illustrating the openings therein for the fluid carrying tubes and the support tubes.
Figure 2:
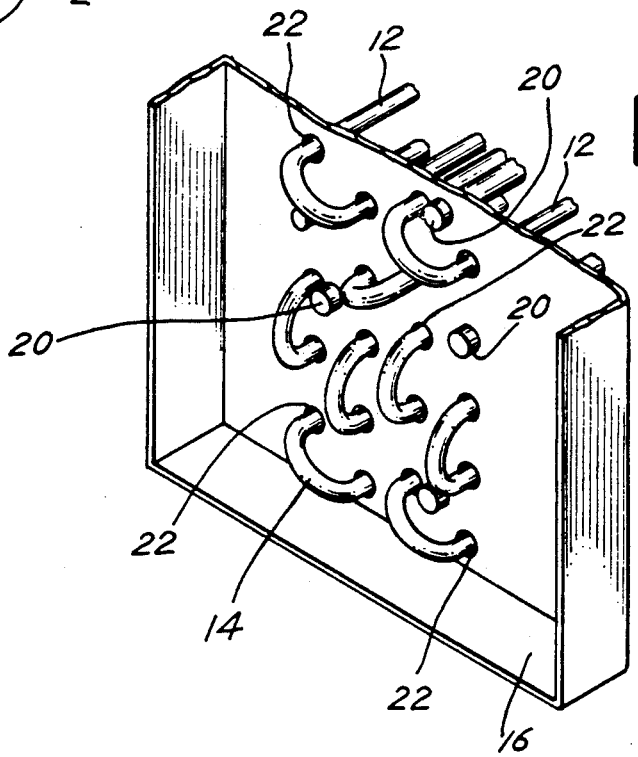
FIG. 2 is an enlarged detail view of a portion of FIG. 1 which shows the relationship of the fluid carrrying tubes of the tube bundle and the support tubes to the supporting end plates.

The tube bundle 10 and supporting mechanism are connected through the use of fins 24. The fins 24 may be planar or corrugated as is well known in the art. Fins 24 operate to direct the flow of air over the tubes 12 as well as provide partial support for the tube bundle 10. The fins 24 run generally parallel to the end plates 16 and center plates 18, and they also contain a plurality of openings 26 and 27 (FIG. 3). The openings 26 in the fins 24 are designed to fit snugly around the tubes 12. The larger openings 27 are designed to fit snugly around the tubes 20. It is preferable that the fins 24 be constructed of a flexible material such as aluminum so that the tubes 12 of the tube bundle 10 are permitted limited movement, and the tube bundle is free floating with respect to the center plate 18 and end plates 16. Since the fins 24 are secured to the tubes 12 and the tubes 20, the tubes 12 carrying the refrigerant fluid may float with respect to the end plates 16, thus eliminating a possible source of leakage.

There has been provided by the present invention an improved air cooled heat exchanger (condenser or evaporator) wherein the fluid carrying tubes are in free floating relationship with the end plates, to prevent abrasion and hence damage to the tubes in the region of the end plates as often occurs in prior known constructions.

While I have shown a presently preferred embodiment of the present invention, it will be apparent to persons skilled in the art that various modifications may be made within the scope of the appended claims.

What is claim is:

1. An air cooled heat exchanger comprising:

a tube bundle; supporting means; and connecting means; the tube bundle comprising a plurality of first tubes, and return bends connecting the ends of pairs of first tubes, the first tubes being substantially parallel to one another and operatively connected at their ends by the return bends to form a circuit for refrigerant, the supporting means comprising a plurality of second support tubes and two end plates, the second support tubes being substantially parallel to one another and to the first tubes of the tube bundle, the second support tubes being fixedly attached at their ends to the end plates, a plurality of openings defined in the end plates, the diameter of said openings being substantially greater then the outside diameter of the first tubes to allow passage of the first tubes through the openings without any contact to permit floating of the first tubes relative to the end plates, the connecting means comprising a plurality of fins, said fins extending generally perpendicular to the first and second tubes and generally parallel to the end plates, the fins being secured to the first tubes and in heat transfer relationship therewith, the fins also being secured to the second tubes whereby the tube bundle is in a floating relationship with respect to the end plates to obviate damage to the first tubes during operation of the air cooled heat exhanger.

2. The air cooled heat exchanger of claim 1 wherein the supporting means also comprises at least one center plate, said center plate being located between the two end plates and being generally parallel to the end plates, a plurality of first openings defined in the center plate, the diameter of said first openings being substantially greater then the outside diameter of the first tubes to allow passage of the first tubes through the openings without any contact to permit free floating of the first tubes relative to the center plate, a plurality of second openings defined in the center plate for receiving the second tubes.

3. The air cooled heat exchanger of claim 2 wherein said second openings have a diameter approximately equal to the outside diameter of the second tubes to allow the center plate to be fixedly attached to the second tubes.

4. The air cooled heat exchanger of claim 1 wherein the fins are constructed of a flexible material connected to the first tubes to form a tube bundle which can freely move with respect to the supporting means.

5. The method of fabricating an air cooled heat exchanger comprising the steps of: forming a refrigerant circuit by connecting pairs of a plurality of generally parallel tubes at their ends by return bends, providing a plurality of parallel support tubes, securing the tubes of the refrigerant circuit and the support tubes with fins, with the fins oriented generally perpendicular to the support tubes and the tubes forming the refrigerant circuit, and securing the support tubes adjacent their ends to end plates, while permitting the ends of the tubes forming the refrigerant circuit to pass freely through openings in the end plates, whereby the tubes of the refrigerant circuit form a tube bundle which is freely floating with respect to the end plates.

6. The method of fabricating an air cooled heat exchanger as in claim 5 including the steps of securing the support tubes to one or more center plates which are located at intervals between the end plates and run generally parallel to the end plates and generally perpendicular to the support tubes.

7. The method of fabricating an air cooled heat exchanger as in claim 6 wherein the step of securing the support tube to the end plates consists of: positioning the support tube in an opening in the end plate, and expanding the support rod to the diameter of the opening in the end plate.

8. The method of fabricating an air cooled heat exchanger as in claim 7 including the step of soldering the connection between each support tube and the end plate.

* * * * *

US005020587C1

(12) EX PARTE REEXAMINATION CERTIFICATE (5172nd)

United States Patent
Mongia et al.

(10) Number: US 5,020,587 C1
(45) Certificate Issued: Aug. 9, 2005

(54) FULLY FLOATING TUBE BUNDLE

(75) Inventors: Manmohan Mongia, Decatur, GA (US); Shelby J. Meade, Wilmington, NC (US)

(73) Assignee: Heatcraft Inc., Grenada, MS (US)

Reexamination Request:
No. 90/006,379, Sep. 6, 2002

Reexamination Certificate for:

| | |
|---|---|
| Patent No.: | **5,020,587** |
| Issued: | **Jun. 4, 1991** |
| Appl. No.: | **07/607,539** |
| Filed: | **Nov. 1, 1990** |

(51) Int. Cl.[7] ..... F28F 7/00
(52) U.S. Cl. ..... 165/82; 165/149; 165/150; 29/890.043
(58) Field of Search ..... 165/82, 81, 149, 165/162, 150, 151; 29/890.043, 890.047

(56) References Cited

U.S. PATENT DOCUMENTS

| | | | | |
|---|---|---|---|---|
| 1,842,218 A | * | 1/1932 | Trane | 165/82 |
| 2,268,361 A | * | 12/1941 | Walker et al. | 165/82 |
| 2,819,045 A | * | 1/1958 | Pearse, Jr. et al. | 165/149 |

FOREIGN PATENT DOCUMENTS

| | | | |
|---|---|---|---|
| DE | 3525239 C1 | * | 9/1986 |
| EP | 0209107 B1 | * | 7/1986 |

OTHER PUBLICATIONS

Shah, R.K. et al. "Compact and Enhanced Heat Exchangers" 1982 International Centre for Heat and Mass Transfer Symposium, pp. 425–468.*

* cited by examiner

*Primary Examiner*—Leonard Leo

(57) ABSTRACT

An air cooled heat exchanger is comprised of a plurality of generally parallel fluid carrying tubes joined at the ends so as to form a refrigerant circuit which is free floating with respect to its means of support. The fluid carrying tubes are directly connected to heat transfer fins running generally perpendicular to the tubes. The fins in turn are connected to non-fluid carrying support tubes which are generally parallel to the fluid carrying tubes. The support tubes are secured at their ends to end plates and as necessary to a center plate or plates. There is no direct contact between the end plates or center plates and the fluid carrying tubes, which are free to move with respect to the end plates and center plate or plates. Therefore, damage to the fluid carrying tubes and leakage which often occurs at the connection between a fluid carrying tube and a support plate due to abrasion caused by vibration and temperature changes is eliminated.

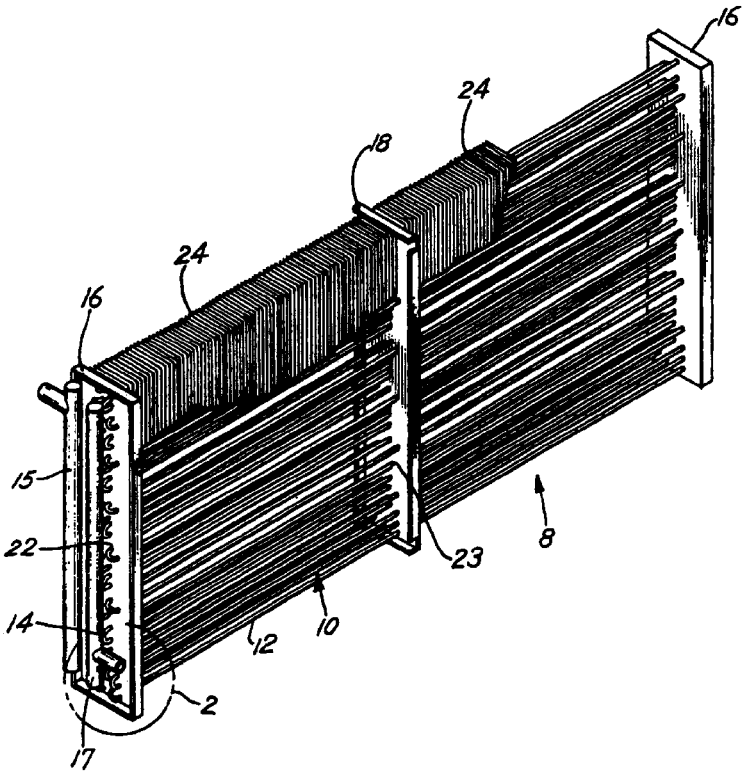

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–8 are cancelled.

* * * * *